United States Patent [19]

Lampe et al.

[11] Patent Number: 4,511,300

[45] **Date of Patent: * Apr. 16, 1985**

[54] APPARATUS FOR GATHERING WRITING PADS OR THE LIKE

[75] Inventors: Siegfried Lampe, Ellerbek; Heinz Lehmann; Peter Dose, both of Hamburg, all of Fed. Rep. of Germany

[73] Assignee: E.C.H. Will (GmbH & Co.), Hamburg, Fed. Rep. of Germany

[ * ] Notice: The portion of the term of this patent subsequent to Sep. 13, 2000 has been disclaimed.

[21] Appl. No.: 531,919

[22] Filed: Sep. 13, 1983

Related U.S. Application Data

[63] Continuation of Ser. No. 269,563, Jun. 2, 1981, Pat. No. 4,403,899.

[30] Foreign Application Priority Data

Jun. 4, 1980 [DE] Fed. Rep. of Germany ..... 3021124

[51] Int. Cl.[3] ..... B65H 31/30

[52] U.S. Cl. ..... 414/35; 198/627; 198/633; 414/43; 414/51; 414/900

[58] Field of Search ..... 414/35, 43, 45, 51, 414/91, 900; 271/223, 224, 299; 198/434, 627, 633

[56] References Cited

U.S. PATENT DOCUMENTS

| | | | |
|---|---|---|---|
| 1,097,012 | 5/1914 | Eldredge | 198/627 X |
| 1,109,259 | 9/1914 | Sons et al. | 198/627 X |
| 3,208,603 | 9/1965 | Kinker | 414/43 |
| 3,463,485 | 8/1969 | Atwood | 414/43 X |
| 3,545,588 | 12/1970 | Corley | 198/633 X |
| 3,595,369 | 7/1971 | Boulay et al. | 198/627 X |
| 3,662,901 | 5/1972 | Brintley | 414/51 X |
| 3,822,793 | 7/1974 | Stobb | 414/43 |

*Primary Examiner*—Leslie J. Paperner
*Attorney, Agent, or Firm*—Peter K. Kontler

[57] ABSTRACT

Apparatus gathering writing pads into stacks has a row of receptacles disposed at a level below the discharge end of a feeding conveyor which delivers several lines of pads, one for each receptacle. The receptacles have a common horizontal floor assembled of spaced-apart elongated strips mounted in a main frame and extending in the longitudinal direction of the row, and the receptacles are separated from each other by separating units having sets of upright rods which extend upwardly through the spaces between the neighboring strips and can be lowered to move out of the way preparatory to removal of assembled stacks of pads by two endless conveyor belts which flank the row of receptacles and have inner reaches movable into engagement with the respective sides of the stacks. The conveyor belts are set in motion after their inner reaches engage the stacks and after the rods are retracted to a level below the floor. The separating units are adjustable lengthwise of the row of receptacles, and certain rods of each separating unit are further movable transversely of the row of receptacles by a carriage which supports one of the belts and is movable toward the other belt, in order to convert the apparatus for the accumulation of stacks consisting of larger, smaller, wider or narrower pads.

10 Claims, 2 Drawing Figures

APPARATUS FOR GATHERING WRITING PADS OR THE LIKE

This application is a continuation of application Ser. No. 269,563, filed June 2, 1981, now U.S. Pat. No. 4,403,899.

BACKGROUND OF THE INVENTION

The present invention relates to apparatus for manipulating accumulations of paper sheets or the like, especially for manipulating piles or interconnected sheets, panels and/or covers in the form of steno pads, note books, brochures, exercise books and like commodities which can be purchased in stationery stores, department stores, supermarkets and like establishments. The sheets of such commodities can be held together by threads, staples, adhesive, spiral binders or other types of fasteners. For the sake of convenience, the commodities which can be manipulated in the apparatus of the present invention will be referred to as pads with the understanding, however, that the apparatus can manipulate other types of commodities which include or consist of overlapping or superimposed sheets, sheets and covers or the like.

It is known to produce and assemble pads in machines which discharge several rows or lines of pads, for example, four rows whose articles are transported along discrete paths, preferably in a common plane which is horizontal or substantially horizontal. The several rows of pads are transported by a feeding conveyor, e.g., by a chain conveyor which is provided with entraining elements serving to push the pads of neighboring rows at predetermined intervals. The feeding conveyor delivers the pads to a stacking station where the pads descend into receptacles. One receptacle is provided for each row or line of pads, and the contents of the receptacles are evacuated by a removing conveyor which transports stacks of pads to a further processing station, e.g., to a station where the stacks are introduced into cardboard boxes or analogous containers, wrapped in paper, confined in plastic foil which is shrunk therearound, or are otherwise prepared for transport to storage or to purchasers. The removing conveyor is normally arranged to advance the accumulated or gathered stacks of pads in a direction at right angles to the direction of transport of pads toward the receptacles at the discharge end of the feeding conveyor. In many instances, the stacks of pads which accumulate at a level below the discharge end of the feeding conveyor are removed by hand and are placed into cardboard boxes, cartons or the like.

A reasonably modern machine for the gathering or accumulation of stacked pads or like commodities is normally equipped with suitable counter means enabling the attendants to select the number of pads in each stack. For example, the number of pads in a stack which consists of relatively thick pads may be smaller or much smaller than the number of pads in a stack which consists of relatively thin pads. Also, at least in certain instances, the height of stacks may depend upon the size of sheets or covers of which the pads are assembled so that the weight of a stack consisting of pads which are assembled of relatively large sheets will not exceed a preselected value. Still further, certain customers prefer smaller stacks (e.g., stacks consisting of eight pads each) and certain other customers prefer larger stacks (e.g., stacks each of which contains ten or twelve superimposed pads). The adjustment can be effected automatically or by hand, i.e., an attendant can adjust the mechanism which actuates the removing conveyor so that each of the receptacles at the discharge end of the feeding conveyor accumulates a given number of pads until the machine completes the making of a predetermined total number of stacks. The counter mechanism is then adjusted so that the machine proceeds with the assembly of stacks each having a larger or smaller number of superimposed pads.

It is further desirable to design a machine of the above outlined character in such a way that it can mix different types of pads. For example, a machine can turn out pads with red, yellow, green, blue and/or otherwise colored covers. In many instances, each row of commodities issuing from the maker contains pads having covers of a different color. The purchaser is likely to demand that each stack contain a given number of pads with red covers, a given number of pads with green covers, a given number of pads with blue covers, etc. This not only enhances the appearance of stacked pads on a shelf but also enables a pupil or another user of pads to purchase a pad with covers of a first color to record information of a first type, a pad with covers of a second color to store information of a second character, and so forth. By way of example, if the feeding conveyor of the machine is designed to supply four rows of pads and the pads of each row have covers of a different color, a buyer may insist that each stack contain eight pads including two pads with green covers, two pads with red covers, etc. The station which can accumulate such types of stacks is called or can be termed a mixed-count gathering station. As a rule, a machine of the just outlined character employs an intermittently driven removing conveyor with several compartments which constitute receptacles for stacks of pads. The removing conveyor is driven stepwise past the discharge end of the feeding conveyor and remains at a standstill for intervals of time which are long enough to enable each compartment to accumulate two pads of a first color while in register with a first row or line on the feeding conveyor, two pads of a second color while in register with the next row or line on the feeding conveyor, and so forth.

It is further desirable that a machine of the above outlined character be designed to accept and process relatively large, small, thick and/or thin pads. In other words, the dimensions of the compartments or receptacles wherein the pads are gathered should be variable so as to ensure proper reception and accurate stacking of differently dimensioned pads. All of the presently known and utilized machines exhibit the serious drawback that any conversion, e.g., a change from stacking of relatively small pads to stacking of somewhat larger pads or vice versa, invariably involves a substantial amount of work by skilled or highly skilled attendants and prolonged interruptions of operation so that each conversion entails very pronounced losses in output. As a rule, the removing conveyor of a conventional gathering machine is a chain conveyor wherein the receptacles are defined by spaced-apart plate-like entraining elements or partitions which define a row of compartments arranged to travel past the discharge end of the feeding conveyor. A change in format necessitates a shifting of entraining elements which is a tedious and time-consuming procedure. Moreover, such machines do not allow for highly accurate selection of optimum dimensions of receptacles or compartments because the number of positions to which the entraining elements or partitions can be moved is rather limited owing to the very nature of the removing conveyor, i.e., if the removing conveyor is a chain, the positions of the entraining elements are determined by the length of links of which the chain is assembled. Still further, such conveyors do not allow for convenient, rapid and accurate adjustment of the dimensions of compartments or receptacles, as considered in the transverse direction of the chain. Thus, whereas a shifting of entraining elements in the longitudinal direction of the chain can entail a desirable or halfway satisfactory selection of the corresponding dimensions of the compartments, additional adjustments of rather complex nature are necessary to ensure adequate stacking of a fresh batch of pads on top of each other by increasing or reducing the dimensions of each compartment as considered at right angles to the longitudinal direction of the chain.

OBJECTS AND SUMMARY OF THE INVENTION

An object of the invention is to provide a novel and improved apparatus for converting several rows of oncoming pads or like commodities into stacks each of which contains a desired number of superimposed pads, and to construct and assemble the apparatus in such a way that it can be rapidly converted for the gathering and removal of stacks consisting of larger or smaller, shorter or longer, narrower or wider, thicker or thinner pads.

Another object of the invention is to provide an apparatus of the above outlined character whose versatility greatly exceeds the versatility of heretofore known and/or utilized apparatus, which can be serviced by semiskilled or even unskilled attendants, which requires a minimum of maintenance, and which can be used for the stacking of identical or different types of pads or analogous commodities.

A further object of the invention is to provide an apparatus which can be converted for the stacking and removal of differently dimensioned pads or like commodities within a small fraction of the time which is required to carry out such conversion in a conventional apparatus.

An additional object of the invention is to provide the apparatus with novel and improved means for rapidly and accurately adjusting the dimensions of receptacles or compartments for accumulations of pads or like commodities at the discharge end of a feeding conveyor which delivers two or more rows of articles.

Still another object of the invention is to provide the apparatus with novel and improved means for engaging and removing freshly gathered stacks of pads from the accumulating station.

A further object of the invention is to provide the apparatus with novel and improved means for removing obstacles from the path of freshly gathered stacks at the discharge end of a multi-row feeding conveyor.

Another object of the invention is to provide an apparatus of the above outlined character wherein all component parts which require frequent attention, adjustment and/or maintenance are readily accessible to the attendants.

The invention resides in the provision of an apparatus for gathering or assembling stacks of writing pads or analogous commodities. The apparatus comprises a row of neighboring receptacles or pockets each having a floor which is preferably stationary and common to all receptacles (the floor preferably consists of several strips extending in the longitudinal direction of the row of receptacles and secured to the main frame of the apparatus), separating means which establish boundaries between neighboring receptacles (and preferably also include units at those sides of the outermost receptacles which face away from the nearest receptacles) and are movable between operative positions in which the neighboring receptacles are separated from each other and retracted positions in which the contents of the receptacles can be evacuated by moving such contents along the floor and lengthwise of the row of receptacles, means for moving the separating means between the operative and retracted positions (such moving means may include means for moving the separating means to upper end positions corresponding to the operative positions and to lower end positions corresponding to the retracted positions, the separating means being disposed below the floor in the lower end positions and extending between the strips and above the level of the floor in their operative positions), and means for feeding commodities into the receptacles, one after the other, so that the receptacles accumulate stacks of superimposed or overlapping commodities. The apparatus further comprises means for removing the accumulated stacks of commodities from the receptacles, and such removing means includes first and second conveyor means flanking the row of receptacles. At least a portion (e.g., the inner reach of an elastically deformable endless belt conveyor) of at least one of the conveyor means is shiftable between a first position nearer to the other of the conveyor means to thereby establish motion transmitting or entraining contact between the stacks of commodities in the receptacles and the conveyor means and a second position more distant from the other conveyor means so that the commodities can readily enter the receptacles during the gathering or accumulating stage of operation of the apparatus. The removing means further comprises means for shifting the one conveyor means between its first and second positons as well as means for advancing the conveyor means to thereby remove the stacks of commodities from the receptacles by moving the stacks in the longitudinal direction of the row of receptacles on movement of the one conveyor means to its first position and on movement of the separating means to their retracted positions.

The feeding means preferably comprises an overhead conveyor which is designed to dump commodities into the receptacles from above.

As mentioned above, the floor for the receptacles is preferably stationary. Each of the conveyor means preferably comprises an endless flexible element (such as the aforementioned elastically deformable belt or band) and upright rotary guide members (e.g., rollers, pulleys or sprocket wheels) for each flexible element. The flexible elements have elongated reaches which are adjacent to the respective sides of the row of receptacles. The aforementioned shifting means then comprises means for moving the reach of the one conveyor means toward or away from the reach of the other conveyor means. Such means for moving the reach of the one conveyor means may comprise an elongated plate-like back support adjacent to that side of the respective reach which faces away from the row of receptacles and being movable, e.g., by a fluid-operated motor through the medium of pivotable levers, with reference to the frame to thereby move the respective reach into or from engagement with the adjacent sides of stacks of pads in the receptacles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat schematic partly plan and partly horizontal sectional view of an apparatus which embodies one form of the invention and is designed for simultaneous accumulation of four stacks of pads or the like.

DESCRIPTION OF THE PREFERRED EMBODIMENTS

Figure 1:
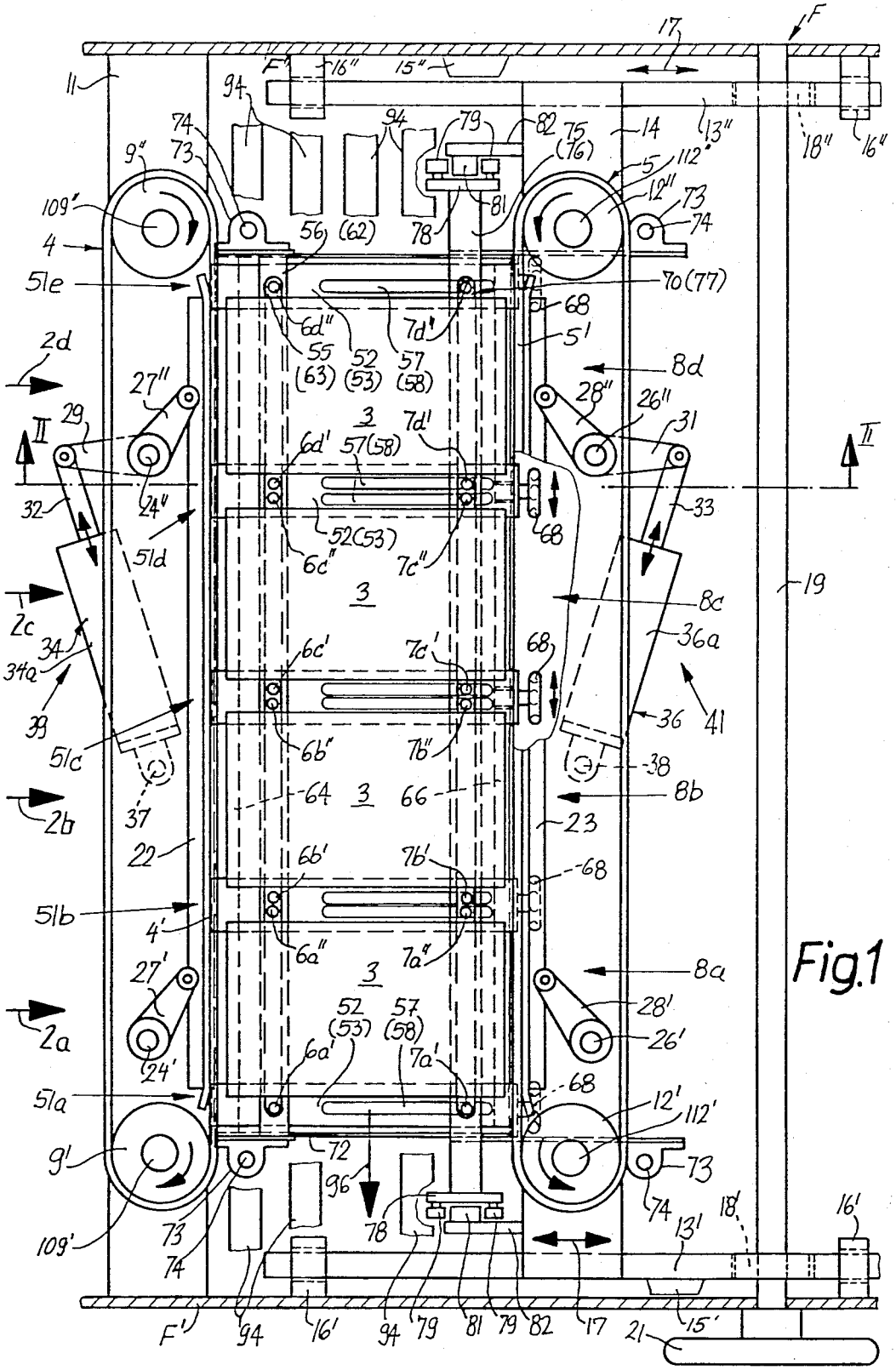

The drawing illustrates one embodiment of the improved apparatus. More specifically, the drawing illustrates an apparatus which can accumulate four stacks of pads 3, one next to the other. The apparatus comprises a feeding conveyor including a discharge end which is denoted by a horizontal platform or plate 1 shown in the upper left-hand portion of FIG. 2. The feeding conveyor preferably comprises one or more endless chain or belt conveyors the upper reaches of which advance in the direction indicated by arrows 2*a* to 2*d*. The conveyor or conveyors which advance in the directions indicated by arrows 2*a* to 2*d* transport four rows or lines of pads 3. The exact construction of the machine which makes pads 3 and delivers or discharges pads onto the feeding conveyor including the platform 1 forms no part of the present invention. It is assumed that each of the pads 3 consists of a plurality of superimposed sheets of paper or the like, and each of the pads 3 may but need not have one or more covers of the type customarily seen on steno pads, note books, exercise books and analogous stationery articles or products. The chain conveyor or conveyors of the feeding conveyor may comprise a plurality of entraining elements in the form of transversely extending partitions which push successive pads 3 of the respective rows onto and beyond the platform 1 shown in FIG. 2. The pads 3 which advance beyond the platform 1 descend into the corresponding receptacles, pockets or compartments 8*a*, 8*b*, 8*c*, 8*d*, shown in FIG. 1. Each of the receptacles 8*a*, 8*b*, 8*c*, 8*d* accumulates a predetermined number of superimposed pads 3 which form four stacks of identical height, and the thus accumulated stacks are thereupon removed from the gathering station accommodating the receptacles 8*a*, 8*b*, 8*c*, 8*d* by a removing conveyor including two endless flexible elements in the form of belts or bands 4 and 5. The row of receptacles 8*a* to 8*d* is flanked by the elongated inner reaches 4' and 5' of the belts 4 and 5, and the receptacles are bounded in part by a plurality of upright separating members in the form of elongated rods 6*a'*, 6*a''*, 7*a'*, 7*a''*, 6*b'*, 6*b''*, 7*b'*, 7*b''*, 6*c'*, 6*c''*, 7*c'*, 7*c''*, 6*d'*, 6*d''*, 7*d'* and 7*d''*. As shown in the lower part of FIG. 1, the lowermost receptacle 8*a* is flanked by the respective portions of the reaches 4', 5' and is bounded by the rods 6*a'*, 7*a'* and 6*a''*, 7*a''*. The adjacent receptacle 8*b* is flanked by the corresponding intermediate portions of the reaches 4', 5' and is bounded by the rods 6*b'*, 7*b'* and 6*b''*, 7*b''*. The next-higher receptacle 8*c* is flanked by the corresponding intermediate portions of the reaches 4', 5' and is bounded by the rods 6*c'*, 7*c'* and 6*c''*, 7*c''*. Finally, the uppermost receptacle 8*d* (as seen in FIG. 1) is flanked by the uppermost portions of the reaches 4', 5' and is bounded by the rods 6*d'*, 7*d'* and 6*d''*, 7*d''*. The rods which define portions of boundaries for the corresponding receptacles are disposed substantially but not necessarily exactly at the four corners of the respective receptacles. As can be seen in the lower portion of FIG. 1, the rods 6*a'*, 6*a''* are slightly spaced apart from the inner reach 4' of the left-hand belt 4, and the rods 7*a'*, 7*a''* are slightly spaced apart from the inner reach 5' of the belt 5. The reaches 4', 5' are spaced apart from the corresponding sides of the stacks of superimposed pads 3 in the receptacles 8*a*, 8*b*, 8*c*, 8*d* during accumulation of such stacks. At such time, the rods are adjacent to the longer sides (namely, the horizontal sides, as viewed in FIG. 1) of the corresponding stacks in the four receptacles 8*a* to 8*d*. The rods 6*a'* to 7*d''* form several stack separating units including the unit 6*a'*, 7*a'* at that side of the receptacle 8*a* which faces away from the nearest receptacle 8*b*; the unit 6*a''*, 7*a''*, 6*b'*, 7*b'* between the neighboring receptacles 8*a*, 8*b*; the unit 6*b''*, 7*b''*, 6*c'*, 7*c'* between the neighboring receptacles 8*b*, 8*c*; the unit 6*c''*, 7*c''* 6*d'*, 7*d'* between the neighboring receptacles 8*c*, 8*d*; and the unit 6*d''*, 7*d''* at that side of the receptacle 8*d* which faces away from the nearest receptacle 8*c*.

The belt 4 is trained around two upright rotary guide members in the form of pulleys 9' and 9'' which are respectively mounted on upright shafts 109', 109'' secured to a horizontal carrier 11 which is fixedly mounted in the main frame or housing F of the apparatus. The material of the belt 4 is at least slightly elastic so that its inner reach 4' can be shifted in a direction to the right, as viewed in FIG. 1, in order to move into frictional engagement with the adjacent left-hand sides of the stacks of pads 3 in the receptacles 8*a* to 8*d*.

The right-hand endless belt 5 is trained about two upright rotary guide members or pulleys 12' and 12'' which are respectively rotatable on or with upright shafts 112', 112'' mounted on an elongated horizontal carrier 14 which is movable sideways (see the double-headed arrows 17 in FIG. 1) toward and away from the fixedly mounted carrier 11 for the shafts 109', 109''. The material of the belt 5 is at least slightly elastic so that its inner reach 5' can be moved into frictional engagement with the adjacent right-hand sides of the stacks of pads 3 in the receptacles 8*a* to 8*d* preparatory to removal of fully assembled stacks from the gathering station shown in FIG. 1.

The end portions of the carrier 14 for the shafts 112', 112'' are affixed to intermediate portions of elongated horizontal toothed racks 13' and 13'' which are movable lengthwise (in the directions indicated by the aforementioned double-headed arrows 17) with reference to stationary bearings 16' and 16''. Such bearings are mounted in the adjacent upright panels or walls F' and F'' of the main frame F.

Figure 2:
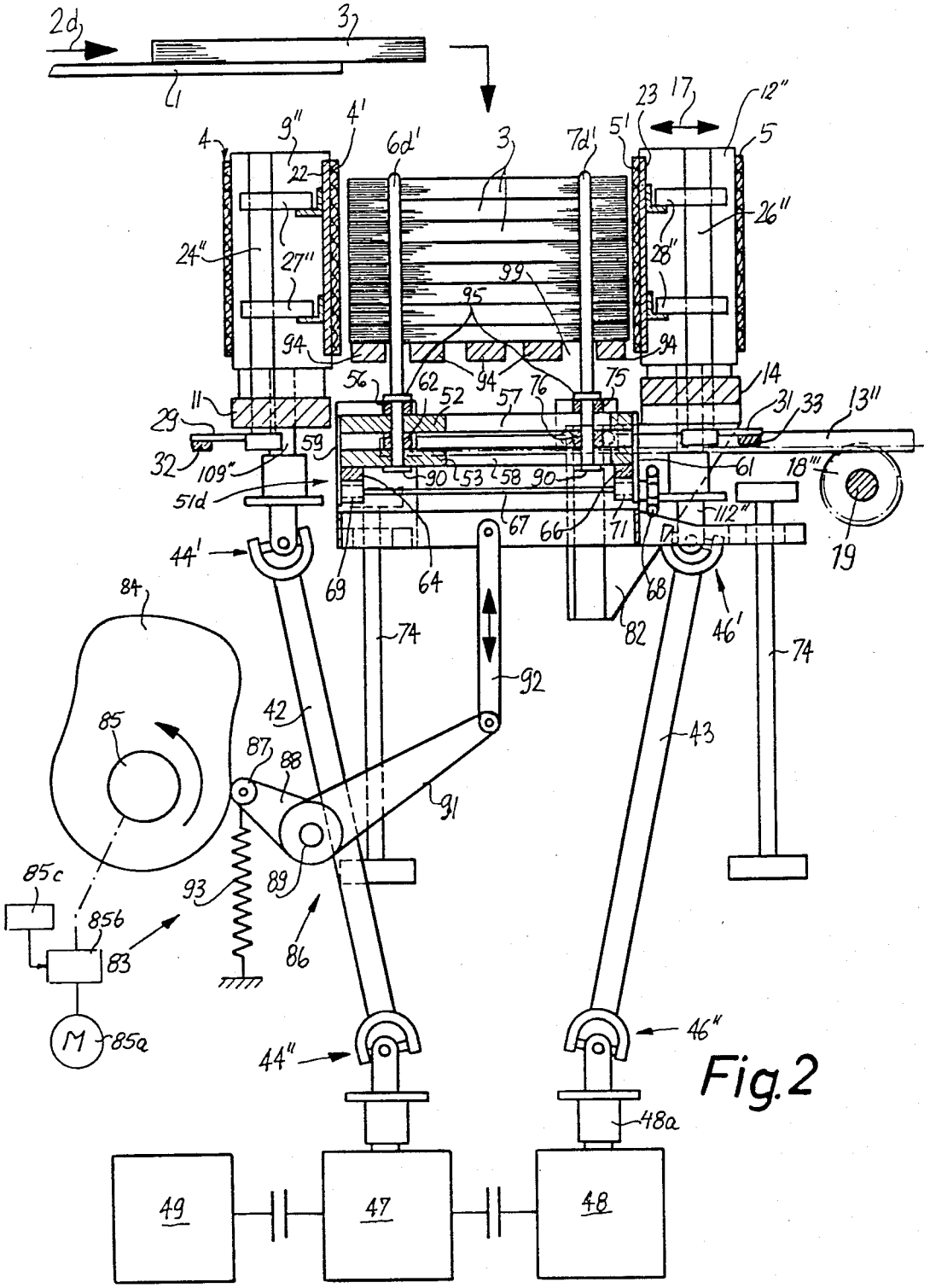
FIG. 2 is a vertical sectional view as seen in the direction of arrows from the line II—II in FIG. 1.

The racks 13' and 13'' constitute component parts of a rack and pinion drive serving as an adjusting means which moves the carrier 14 (and hence the entire conveyor including the belt 5) toward and away from the carrier 11 for the purpose of conversion so that the apparatus can accumulate stacks consisting of pads which are larger or smaller than the pads 3 shown in FIGS. 1 and 2. The rack and pinion drive for the carrier 14 further comprises two pinions 18' and 18" which are mounted on a horizontal shaft 19 (see particularly the right-hand portion of FIG. 1) and respectively mesh with the racks 13' and 13". The shaft 19 is further connected with a hand wheel 21 (see the lower right-hand portion of FIG. 1) which can be rotated by hand to thereby move the racks 13' and 13" in synchronism in a direction toward or away from the stationary carrier 11. This increases or reduces the distance between the inner reaches 4' and 5' of the belts 4 and 5 in undeformed condition of such belts.

The reference characters 15' and 15" respectively denote clamping devices which serve to arrest the carrier 14 in a selected position, namely, at a selected distance from the stationary carrier 11. The clamping devices 15' and 15" constitute simple wedges which can be driven between the walls F' and F" on the one hand and the toothed racks 13', 13" on the other hand. It goes without saying that the wedges 15' and 15" constitute the most elementary or rudimentary forms of clamping devices, i.e., the apparatus which is shown in FIGS. 1 and 2 can be equipped with more sophisticated clamping means for releasably holding the carrier 14 in a selected position in which the inner reaches 4' and 5' of the belts 4 and 5 are held at a selected distance from each other.

The inner reach 4' of the belt 4 has an outer side which is adjacent to an elongated plate-like back support 22 extending substantially from the pulley 9' and close to the pulley 9" and serving to ensure that the inner reach 4' will properly engage the adjacent sides of the four stacks of pads 3 when the back support 22 is moved in a direction to the right, as viewed in FIG. 1. To this end, the back support 22 is articulately connected with a first pair of aligned one-armed levers 27' (only one shown) which are adjacent to the pulley 9', and with a second pair of aligned one-armed levers 27" which are adjacent to the pulley 9". The levers 27' and 27" are respectively secured to upright shafts 24', 24" which are mounted on the carrier 11. The shaft 24" for the levers 27" is further rigidly connected with a lever 29 the free end portion of which is articulately connected to the outer end of a piston rod 32 forming part of a fluid-operated motor here shown as a double-acting pneumatic cylinder-and-piston unit 34. The cylinder 34*a* of the motor 34 is articulately connected to the carrier 11 by a vertical shaft 37. When the motor 34 is actuated to expel the piston rod 32 from the cylinder 34*a*, the levers 29 and 27" are caused to pivot in a clockwise direction as viewed in FIG. 1, and cooperate with the levers 27', (which then turn about the axis of the shaft 24') to move the back support 22 in a direction to the right, as viewed in FIG. 1, in order to urge the reach 4' of the expansible elastic belt 4 against the adjacent sides of the four stacks of pads 3 in the receptacles 8*a* to 8*d*.

The inner reach 5' of the belt 5 is inwardly adjacent to a second elongated back support 23 which is a mirror image of the back support 22 and is articulately connected to a first pair of one-armed levers 28' (only one shown) mounted on a shaft 26' which is secured to the carrier 14, and a second pair of one-armed levers 28" secured to a vertical shaft 26" mounted on the carrier 14. The shaft 26" is rigid with a further lever 31 the free end portion of which is articulately connected to the outer end portion of a piston rod 33 forming part of a second fluid-operated motor here shown as a double-acting pneumatic cylinder-and-piston unit 36 whose cylinder 36*a* is pivotable on a vertical shaft 38 secured to the carrier 14. When the cylinder 36*a* receives pressurized fluid so as to expel the piston rod 33, the levers 31, 28', 28" pivot in a counterclockwise direction, as viewed in FIG. 1, in order to move the back support 23 against the outer side of the reach 5' and to deform the belt 5 so that the reach 5' can firmly engage the adjacent right-hand sides of the four stacks of pads 3 in the receptacles 8*a* to 8*d*. At such time, the removing conveyor including the belts 4 and 5 is ready to transport the four stacks of pads 3 away from the gathering station of FIG. 1. The removal takes place in the direction which is indicated by an arrow 96, i.e., downwardly as viewed in FIG. 1. The removal of four stacks of pads 3 must be preceded by withdrawal of the rods 6*a*' to 7*d*" (or at least of the rods 6*a*' to 7*d*') from the paths of movement of the stacks of pads 3 in the direction of arrow 96. Such removal is effected by displacing the rods 6 and 7 downwardly to a level below the undersides of the lowermost pads 3 of all four stacks.

The reference character 39 denotes in FIG. 1 the shifting mechanism or means for moving the reach 4' of the belt 4 into and away from engagement with the stacks of pads 3 in the receptacles 8*a* to 8*d*. The reference character 41 denotes the shifting mechanism (including the motor 36) which is used to move the reach 5' of the belt 5 into and away from engagement with the stacks of pads 3 at the gathering station between the belts 4 and 5. The mechanism 39 is mounted on the stationary carrier 11, and the mechanism 41 is mounted on and shares all movements of the carrier –with reference to the stationary carrier 11.

The means for intermittently rotating the pulleys 9' and 9" in order to move the inner reach 4' of the belt 4 in the direction of arrow 96 is illustrated in FIG. 2. Such rotating means is designed to transmit torque to the pulley 9" and comprises a bevel gear transmission 47 (schematically shown in the lower portion of FIG. 2) which can drive the shaft 109" for the pulley 9" by way of a first universal joint 44', a cardan shaft 42 and a second universal joint 44". Rotary movements of the pulley 9" for the belt 4 are synchronized with rotary movements of the pulley 12" which can transmit motion to the endless belt 5. The lower end portion of the shaft 112" for the pulley 12" is connected with the upper end portion of a second cardan shaft 43 by a universal joint 46'. The lower end portion of the cardan shaft 43 is articulately connected to the rotary output element 48*a* of a second bevel gear transmission 48 by a universal joint 46". The transmissions 47 and 48 receives motion from a stepping motor 49 which is shown in the lower left-hand portion of FIG. 2. The operation of the transmission 47 is synchronized with the operation of the transmission 48 so that the shafts 109" and 112" are rotated at the same speed and through identical numbers of revolutions but in opposite directions. This ensures that the inner reaches 4' and 5' of the belts 4 and 5 can advance in the same direction, namely, in the direction indicated by the aforementioned arrow 96 shown in the lower portion of FIG. 1.

The rods 6*a*', 7*a*' are mounted on a first horizontal carriage 51*a* which is shown in the lower portion of FIG. 1 and extends transversely of the inner reaches 4', 5' of the belts 4 and 5. The rods 6*a*", 6*b*', 7*b*' and 7*a*" are mounted on a second horizontal carriage 51*b* which is disposed between the receptacles 8*a* and 8*b*. The rods 6*b*", 6*c*', 7*c*' and 7*b*" are mounted on a third horizontal carriage 51*c* which is disposed between the receptacles 8*b* and 8*c*. A fourth horizontal carriage 51*d* which is disposed between the receptacles 8*c* and 8*d* supports the rods 6*c*'', 6*d*', 7*d*' and 7*c*''. Finally a fifth horizontal carriage 51*e* supports the rods 6*d*'', 7*d*'' at the upper side of the receptacle 8*d*, as viewed in FIG. 1. The carriages 51*a* to 51*e* form part of means for adjusting the five separating units in and counter to the direction of arrow 96.

FIG. 2 shows the construction of the carriage 51*d*. This carriage comprises two spaced-apart superimposed supporting members or boards 52 and 53 which are rigidly connected with the lower end portions of the rods 6*c*'' and 6*d*'. The lower end portions of the rods 7*c*'' and 7*d*' are shiftably or adjustably connected to the supporting members 52 and 53 of the carriage 51*d* in a manner which is also shown in FIG. 2. To this end, the supporting members 52 and 53 are respectively formed with elongated slots 57 and 58 which extend transversely of the inner reaches 4' and 5'. It will be noted that the carriage 51*d* is located at a level below the receptacles 8*a* to 8*d*. The same holds true for the other four carriages 51*a*, 51*b*, 51*c* and 51*e*. The carriages 51*b* and 51*c* are identical with the carriage 51*b*. Thus, each of the supporting members 52, 53 forming part of the carriage 51*b* or 51*c* is formed with two elongated slots 57, 58 because the right-hand portions of the carriages 51*b* and 51*c* respectively support the rods 7*a*'', 7*b*' and 7*b*'', 7*c*' each of which is shiftable toward and away from the inner reach 4' of the belt 4. On the other hand, the supporting members 52, 53 of the two outermost carriages 51*a* and 51*e* are respectively formed with a single slot 57 and a single slot 58 because the carriage 51*a* must reciprocally support a single rod (7*a*') and the carriage 51*e* must reciprocally support a single rod (7*d*'').

Referring again to FIG. 2, the left-hand end faces of the supporting members 52, 53 forming part of the carriage 51*d* are connected to each other by a vertical side wall or cheek 59. A similar side wall or cheek 61 is provided to connect the right-hand portions of the supporting members 52 and 53 to each other so that such members are maintained at a requisite distance from each other, namely, in two spaced parallel horizontal planes.

The five carriages 51*a* to 51*e* are movably mounted on elongated horizontal guide rails 56 and 62. The guide rail 56 is located at a level above the supporting members 52 of all five carriages 51*a* to 51*e*, and the guide rail 62 is disposed in the spaces between the upper and lower supporting members 52, 53 of such carriages. The guide rails 56 and 62 extend in parallelism with and are located at a level below the inner reaches 4' and 5' of the belts 4, 5 constituting the removing conveyor of the improved apparatus.

The guide rail 56 has an elongated slot 55, and the guide rail 62 has an elongated slot 63 for the rods 6*a*' to 6*d*''. The supporting member 53 is located above two toothed racks 64 and 66 which extend in the longitudinal direction of the row of receptacles 8*a* to 8*d*. A horizontal shaft 67 is journalled in the side walls or cheeks 59, 61 of each of the carriages 51*a* to 51*e*, and each shaft 67 is provided with a hand wheel 68. Furthermore, each of the shafts 67 carries two gears or pinions 69, 71 which respectively mesh with the toothed racks 64 and 66. Each of the carriages 51*a* to 51*e* is further provided with a clamping device (not specifically shown) which serves to releasably hold the corresponding carriage in a selected position, as considered in the longitudinal direction of the toothed racks 64 and 66. These racks are parallel with the reaches 4' and 5' of the removing conveyor including the belts 4 and 5.

The rails 56, 62 and the toothed racks 64, 66 form component parts of an auxiliary frame or skeleton frame 72 which has four sleeves or eyelets 73 (see FIG. 1) slidable up and down along upright guide members or posts 74.

The adjusting means for moving the rods 7*a*' to 7*d*'' in the corresponding slots 57 and 58, i.e., toward or away from the reach 4' of the belt 4, comprises two elongated guide rails 75, 76 which are parallel with the reaches 4', 5' and have elongated slots 70, 77 extending in parallelism with the row of receptacles 8*a* to 8*d*. The rods 7*a*' to 7*d*'' extend upwardly through the slots 70 and 77 when the apparatus is ready to gather or accumulate four stacks of pads 3. The guide rail 75 is installed at a level above the supporting members 52 of the carriages 51*a* to 51*e*, and the guide rail 76 is disposed between the supporting members 52 and 53. The means for moving the guide rails 75, 76 sideways, i.e., toward the reach 4' or toward the reach 5', comprises holders 78 which are affixed to the ends of the guide rails 75, 76 and carry pairs of rollers 79 flanking vertical guides 81 in the form of polygonal posts provided on arms or brackets 82 secured to the movable carrier 14 for the belt 5. The guide rails 75, 76 thus share the movements of the carrier 14 when the latter is shifted sideways in response to rotation of the shaft 19. The rods 7*a*' to 7*d*'' are disposed at the intersections of the slots 70, 77 of the guide rails 75, 76 with the slots 57, 58 of the respective supporting members 52, 53. This means that the rods 7*a*' to 7*d*'' (or at least some of these rods) move up or down, as viewed in FIG. 1, in response to movement of the corresponding carriages 51*a* to 51*e* lengthwise of the row of receptacles 8*a* to 8*d*, and that the rods 7*a*' to 7*d*'' move toward or away from the reach 4' of the belt 4 when the carrier 14 is moved in a direction to the left or to the right, as viewed in FIG. 1.

The apparatus of FIGS. 1 and 2 further comprises means 83 for moving the auxiliary frame 72 up or down to thereby move the rods 6*a*' to 7*d*'' to the operative positions shown (for some of these rods) in FIG. 2 or to inoperative or retracted positions in which the rods 6*a*' to 7*d*'' (or certain of these rods) are withdrawn from the path of movement of stacks of pads 3 in the direction indicated by arrow 96. In the illustrated embodiment, the rods 6*a*' to 7*d*'' are movable up and down, i.e., between operative or raised positions and inoperative or lower end positions in which their upper ends are located at a level below a composite bottom wall or floor (including strips 94) which is common to the four receptacles 8*a* to 8*d*.

The means 83 for moving the auxiliary frame 72 comprises a rotary disc cam 84 mounted on a camshaft 85 which is driven, at requisite intervals, by the main prime mover 85*a* of the machine which produces the pads 3. The periphery of the cam 84 is tracked by a roller follower 87 which serves to transmit motion to a linkage 86 including a horizontal shaft 89, a lever 88 which is rigidly connected to the shaft 89 and carries the roller follower 87, a pair of spaced-apart levers 91 (only one shown) which are pivotable by the shaft 89, and a pair of links 92 (only one shown) which articulately connect the levers 91 with the auxiliary frame 72 in the regions of the two outermost carriages 51*a* and 51*e*. A helical spring 93 is provided to permanently bias the lever 88 in a counterclockwise direction, as viewed in FIG. 2, i.e., to urge the roller follower 87 against the periphery of the cam 84.

The lower end portions of the rods 6a' to 7d'' carry heads 90 which abut against the undersides of the respective supporting members 53 and cooperate with nuts, split rings or analogous retaining elements 95 at a level above the upper sides of the supporting members 52 to hold the rods 6a' to 7d'' against axial movement with reference to the auxiliary frame 72.

The aforementioned common bottom wall or floor of the receptacles 8a to 8d comprises the elongated laths or strips 94 which are parallel to the reaches 4' and 5' of the belts 4, 5 and are secured to the main frame F so that they remain at the illustrated level. The bottom wall or floor including the strips 94 is installed at a level above the carriages 51a to 51e and at least some of its strips 94 are or can be adjustably or removably mounted in the main frame F so as to provide room for extensive adjustments of the distance between the carrier 11 and the carrier 14. As can be seen in FIG. 2, the rods 7a' to 7d'' extend through the gap 99 between the two rightmost strips 94 and the width of this gap is sufficient to allow for a reasonable range of adjustments of the distance between the stationary carrier 11 and the laterally shiftable carrier 14. If the adjustment is larger than possible in view of the illustrated width of the gap 99, the distance between the strips 94 of the bottom wall or floor for the receptacles 8a to 8d is changed accordingly. To this end, the end portions of some or all of the strips 94 can be releasably secured to the corresponding frame members F' and F'' by means for screws, bolts and nuts or analogous removable or separable fasteners, not shown. As a rule, it suffices to adjustably mount two or more strips 94 which are nearest to the reach 5' of the belt 5.

The operation of the improved apparatus is as follows:

The feeding conveyor delivers four lines or rows of pads 3 which are advanced onto and beyond the platform 1 so that they descend by gravity into the corresponding receptacles 8a to 8d. The pads 3 which are supplied by the feeding conveyor advance in the directions indicated by the arrows 2a to 2d. The arrangement is preferably such that each pad 3 which is about to descend into the receptacle 8a is in alignment with three additional pads 3, namely, with the pads which are about to enter the other three receptacles 8b, 8c and 8d. This ensures that each of the four receptacles 8a to 8d accumulates a full stack of, for example, eight pads 3 simultaneously with the other receptacles. The number of pads 3 which are delivered into each of the receptacles 8a to 8d is determined in advance by an adjustable counter 85c which is a conventional component of the pad making machine, i.e., of the machine which supplies pads to the feeding conveyor including the platform 1.

When each of the four receptacles 8a to 8d accumulates a stack of requisite height (i.e., a stack containing eight superimposed pads 3), the counter 85c arrests the machine which supplies the pads 3 to the platform 1 or otherwise interrupts the delivery of pads to the receptacles 8a to 8d. At the same time, the prime mover 85a causes the camshaft 85 to perform one full revolution (to this end, the counter 85c or another component of the machine that makes pads energizes or activates a clutch 85b which connects the prime mover 85a with the shaft 85). As the camshaft 85 rotates, the cam 84 cooperates with the spring 93 to cause the linkage 86 to first move the auxiliary platform 72 downwardly along the guide members 74 so that the rods 6a' to 7d'' are retracted to a level below the bottom wall or floor including the strips 94.

At the same time, or shortly after the camshaft 85 is set in rotary motion, the mechanisms 39 and 41 cause the back supports 22 and 23 to move the reaches 4' and 5' of the belts 4 and 5 against the corresponding sides of the four fully grown stacks of pads 3 in the receptacles 8a to 8d. The engagement between the stacks and the reaches 4' and 5' is sufficiently pronounced to ensure that the stacks of pads will move in the direction of arrow 96 when the stepping motor 49 is thereupon started to rotate the pulleys 9'' and 12'' in the directions indicated by arrows so that the stacks of pads 3 are caused to leave the gathering station below the platform 1. The stepping motor 49 is arrested when the transmissions 47 and 48 complete the advancement of belts 4 and 5 through distances which are necessary to remove all four fully grown stacks from the gathering station. In the next step, the back supports 22 and 23 are retracted so that each of the reaches 4' and 5' can reassume its undeformed condition, and the links 92 lift the auxiliary frame 72 back to the normal level during the last stage of rotation of the cam 84. The configuration of the peripheral surface of the cam 84 is such that the interval of dwell of rods 6a' to 7d'' in their lower end positions suffices to allow the reaches 4', 5' (in deformed condition of each of the belts 4 and 5) to remove the four fully grown stacks of pads 3 from the gathering station.

If the apparatus is to mix pads 3 coming in the directions indicated by arrows 2a to 2d, the programming means for the stepping motor 49 must be adjusted or modified accordingly. Also, such conversion necessitates a relatively simple adjustment of the means which energizes or deenergizes the clutch 85b to rotate the camshaft 85. For example, if each of the four stacks is to contain two pads 3 arriving in the direction of arrow 2a, two pads arriving in the direction of arrow 2b, two pads arriving in the direction of arrow 2c and two pads arriving in the direction of arrow 2d, the cam 84 is caused to complete one full revolution after delivery of two pads 3 into each of the receptacles 8a to 8d, and the belts 4, 5 are thereupon caused to advance the partly and fully grown stacks in the direction of arrow 96 through a distance equaling that between the centers of two neighboring receptacles. The same operation is repeated again when the feeding conveyor completes the delivery of two additional pads into each of the receptacles 8a–8d, and so forth, whereby the belts 4, 5 advance the four stacks by a step always after the foremost receptacle 8a completes the accumulation of a full stack of eight superimposed pads 3 including two pads received from the lane indicated by the arrow 2a, two pads received from the lane indicated by the arrow 2b, two pads received from the lane indicated by the arrow 2c, and two pads received from the lane indicated by the arrow 2d. If the number of receptacles is less than or exceeds four, the number of paths along which the feeding conveyor delivers pads 3 is changed accordingly. Also, if the person in charge wishes to obtain a different mixture of pads in each of the stacks, the operation of the prime mover 85a and stepping motor 49 is altered accordingly, e.g., to accumulate stacks of twelve pads each wherein each stack contains three pads with red covers, three pads with yellow covers, three pads with blue covers and three pads with covers of another color.

If the apparatus is to be adjusted so as to change the width and/or length of the receptacles 8*a* to 8*d* because the feeding conveyor delivers pads 3 which are shorter, longer, wider or narrower than the illustrated pads, the attendant rotates the hand wheel 21 to move the carrier 14 toward or away from the fixed carrier 11. This reduces the initial distance between the reaches 4' and 5', i.e., the distance between such reaches in undeformed condition of each of the belts 4 and 5. The rods 7*a'* to 7*d''* share the movement of the carrier 14 and move (with the slots 70, 77) sideways in the respective slots 57 and 58, i.e., tranversely of the reaches 4', 5'.

If the dimensions of the next batch of pads 3 are such that the dimensions of the receptacles 8*a* to 8*d* must be changed in or counter to the direction indicated by the arrow 96, the attendant rotates the hand wheels 68 so as to move the carriages 51*a* to 51*e* (or selected carriages) toward or away from each other whereby the rods 6*a'* to 6*d''* move in the slots 55, 63 and the rods 7*a'* to 7*d''* move in the slots 70, 77, i.e., at right angles to the longitudinal directions of the slots 57, 58 which share the movements of the carriages in or counter to the direction indicated by the arrow 96.

An important advantage of the improved apparatus is that the removing conveyor including the belts 4 and 5 need not be provided with entraining means in the form of plates, partitions or like parts which are customary on removing conveyors of conventional apparatus. The absence of such entraining means renders it possible to change the corresponding dimensions of the receptacles 8*a* to 8*d*, i.e., to increase or reduce the length of the receptacles by moving the separating units on the carriages 51*a* to 51*e* (or at least one of the carriages 51*b*–51*e* or 51*a*–51*d*) toward or away from each other, as considered in or counter to the direction of the arrow 96. All that counts is to properly engage the stacks of articles 3 by the reaches 4' and 5' of the two belts 4 and 5 so that the frictional engagement between the commodities constituting the fully assembled stacks on the floor including the strips 94 and the reaches 4' and 5' suffices to ensure that the stacks are removed from the gathering station when the stepping motor 49 is started to effect rotation of the pulleys 9'' and 12'' by way of the respective bevel gear transmissions 47 and 48.

It will be seen that, by the simple expedient of utilizing a removing conveyor which need not employ plate-like partitions or analogous entraining means, one can readily adjust the dimensions of the receptacles 8*a* to 8*d*, as considered in the longitudinal direction of the row of receptacles. Furthermore, by the simple expedient of mounting the belt 5 and its pulleys 12', 12'' on the carrier 14 which is movable sideways toward and away from the carrier 11, one can change the dimensions of the receptacles 8*a* to 8*d*, as considered at right angles to the direction indicated by the arrow 96. Since the rods 7*a'* to 7*d''* are mounted on the carrier 14, they invariably share the movements of the carrier 14 with reference to the carrier 11. The positions of the rods 6*a'* to 6*d''* in a direction at right angles to the longitudinal direction of the row of receptacles 8*a* to 8*d* need not be changed because the distance between this file of rods and the reach 4' of the conveyor belt 4 can be readily selected in such a way that it is satisfactory for the narrowest or widest pads which are intended to be gathered in the apparatus of the present invention.

While it is possible to fixedly mount the back support 22 or 23 on the respective carrier 11 or 14, i.e., to deform only the reach 4' or 5' but to such an extent that the single deformed reach moves into adequate frictional engagement with the adjacent sides of the stacks of pads 3 as well as that the single deformed reach pushes the stacks into adequate frictional engagement with the other reach (5' or 4'), the construction which is shown in the drawing is preferred at this time becuse it does not necessitate any shifting of stacked pads 3 at right angles to the longitudinal direction of the row of receptacles 8*a* to 8*d*, i.e., the reach 4' moves in a direction to the right and the reach 5' moves in a direction to the left (as viewed in the drawing) preparatory to starting of the advancing means 49 to remove the stacks of pads 3 from the gathering station (upon retraction of the rods 6*a'* to 7*d''* (or at least of the rods 6*a'* to 6*d'* and 7*a'* to 7*d'*) to their lower end positions at a level below the floor 94).

The movability of both inner reaches (4' and 5') toward each other is further desirable on the ground that neither of these reaches must undergo substantial or pronounced deformation in order to properly engage the respective sides of the stacks of pads in the four receptacles. As a matter of fact, if the width of the receptacles 8*a* to 8*d* (in undeformed condition of the reaches 4' and 5') only slighly exceeds the corresponding dimensions of the pads 3 supplied by the feeding conveyor, the innate elasticity of conventional endless belts will suffice to ensure adequate frictional engagement with the stacks preparatory to advancement of such stacks in the direction of arrow 96.

The carrier 14 is preferably movable between a plurality of positions, most preferably between an infinite number of positions, with reference to the carrier 11 to thus ensure that the width of each receptacle can be selected practically at will within the entire range of widths which must be taken into consideration in connection with the stacking of pads or analogous commodities. The rack and pinion drive including the racks 13', 13'', shaft 19 with hand wheel 21, and gears or pinions 18', 18'' has been found to be especially suited for such purposes because it enables the operator to accurately select the position of the carrier 14 with reference to the carrier 11.

It is equally within the purview of the invention to fixedly mount the racks 13', 13'' on the frame F and to mount the shaft 19 with hand wheel 21 and pinions 18', 18'' on the carrier 14. The illustrated construction is preferred at this time because it enhances the stability of the carrier 14, i.e., each of the racks 13', 13'' is slidably guided in a pair of spaced-apart bearings (16' and 16'') to thus ensure that the orientation of the carrier 14 with reference to the main frame F remains unchanged while the carrier 14 is free to move sideways toward or away from the carrier 11.

The provision of rack and pinion drives for each of the carriages 51*a* to 51*e* is desirable and advantageous on the ground that such drives allow for movement of each carriage to a plurality (actually to an infinite number) of different positions in order to properly adjust or select the corresponding dimensions of the rectpacles 8*a* to 8*d*.

It has been found that the pads 3 which are delivered by the feeding conveyor can be properly confined in receptacles whose dimensions are only slightly greater than those of the pads if the rods 6*a'* to 6*d''* are relatively close to the reach 4' of the belt 4 and the rods 7*a'* to 7*d''* are relatively close to the reach 5' of the belt 5. The feature that the apparatus comprises means for moving the rods 7*a'* to 7*d''* toward or away from the rods 6a' to 6d'' is desirable and advantageous for the just mentioned reason, i.e., to ensure that the rods 7a' to 7d'' remain rather close to the reach 5' even if the carrier 14 is moved sideways toward or away from the carrier 11. While it is conceivable to provide a discrete adjusting device for each of the separating rods 7a' to 7d'', the arrangement which is shown in the drawing is preferred at this time because it allows for automatic retention of the originally selected distance between the reach 5' and the file of rods 7a' to 7d'' since the rods 7a' to 7d'' share all movements of the carrier 14 (and hence of the conveyor belt 5 and its rotary guide means 12', 12'') with reference to the carrier 11. The insertion of rods 7a' to 7d'' into the intersections of slots 70, 77 with the slots 57, 58 of the carriages 51a to 51e renders it possible to move the rods 7a' to 7d'' with the carrier 14 as well as relative to the carrier 14, i.e., in response to shifting of selected carriages 51a to 51e lengthwise of the row of receptacles 8a to 8d.

The mounting of rails 75, 76 in such a way that they alternate with the supporting members 52, 53 of the carriages 51a to 51e renders it possible to ensure adequate guidance of the rods 7a' to 7d'' because portions of such rods are alternately contacted by surfaces flanking the slots in the rail 75, in the supporting member 52, in the rail 76 and in the supporting member 53. As shown in FIG. 2, the height of the brackets 82 and vertical guide members 81 for the rails 75, 76 is sufficient to ensure that the rails 75, 76 are guided at all times, i.e., in the upper end positions (operative positions) of the rods 6a' to 7d'', in the lower end positions (retracted positions) of such rods, as well as during movement of the rods between their upper and lower end positions.

FIG. 2 further shows that all or nearly all parts which are likely to require frequent attention, maintenance or inspection are installed at a level below the floor including the strips 94. Furthermore, the auxiliary frame 72 is even more readily accessible after movement of the rods 6a' to 7d'' to their lower end positions in which their tips or upper end portions do not extend above the respective gaps 99 between the strips 94. The entire auxiliary frame 72 is located at a level below the strips 94, and the same holds true for the carriages 51a to 51e. As mentioned above, the strips 94 are preferably adjustable with reference to the main frame F or, at the very least, some of such strips can be adjustably mounted in the frame members F' and F''. Alternatively, one or more strips 94 are simply removed or reinserted if the attendants desire to change the distance between the carrier 14 and the fixed carrier 11. Lateral shifting of one or more strips 94 will normally suffice if the desired adjustment of the carrier 14 with reference to the carrier 11 is not extensive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for gathering stacks of pads or analogous commodities, comprising a row of neighboring receptacles having a floor; means for feeding commodities into said receptacles so that the receptacles accumulate stacks of commodities; and means for removing the stacks from said receptacles, including first and second conveyor means flanking said row, each of said conveyor means comprising an endless flexible element and upright rotary guide members for such flexible element, each of said flexible elements having an elongated reach adjacent to the respective side of said row, at least a portion of at least one of said conveyor means being shiftable between a first position nearer to the other of said conveyor means to thereby establish motion transmitting contact between the stacks and said conveyor means and a second position distant from said other conveyor means, means for shifting said portion of said one conveyor means between said first and second positions including means for moving said reach of said one conveyor means toward and away from said other conveyor means, said moving means including a reciprocable back support adjacent to that side of the respective reach which faces away from said row, and means for advancing said conveyor means to remove the stacks from said receptacles in the longitudinal direction of said row on movement of said portion of said one conveyor means to said first position.

2. The apparatus of claim 1, wherein said feeding means comprises an overhead conveyor arranged to dump commodities into said receptacles from above.

3. The apparatus of claim 1, further comprising a second back support adjacent to that side of the reach of said other conveyor means which faces away from said row.

4. The apparatus of claim 3, wherein said shifting means further comprises means for moving said second back support toward and away from the reach of said one conveyor means.

5. The apparatus of claim 1, further comprising adjusting means for displacing one of said conveyor means, in its entirety, toward and away from the other of said conveyor means.

6. The apparatus of claim 5, further comprising carrier means for the displaceable conveyor means, said adjusting means comprising a rack and pinion drive for moving said carrier means with reference to said row.

7. The apparatus of claim 6, further comprising a frame for said drive, said drive comprising a plurality of toothed racks secured to said carrier means, a shaft rotatably mounted in said frame, and gears mounted on said shaft and meshing with said racks so that said racks move with said carrier means in response to rotation of said shaft.

8. The apparatus of claim 7, further comprising bearing means provided on said frame and reciprocably supporting said toothed racks.

9. Apparatus for gathering stacks of pads or analogous commodities, comprising a row of neighboring receptacles having a floor; means for feeding commodities into said receptacles so that the receptacles accumulate stacks of commodities; and means for moving the stacks from said receptacles, including first and second conveyor means flanking said row, each of said conveyor means comprising an endless flexible element and upright rotary guide members for each flexible element, each of said flexible elements having an elongated reach adjacent to the respective side of said row, at least a portion of at least one of said conveyor means being shiftable between a first position nearer to the other of said conveyor means to thereby establish motion transmitting contact between the stacks and said conveyor means and a second position distant from said other conveyor means, means for shifting said portion of said one conveyor means between said first and second positions including means for moving said reach of said one conveyor means toward and away from said other conveyor means, said moving means including a reciprocable back support adjacent to that side of the respective reach which faces away from said row and said shifting means further comprising means for moving said back support toward and away from said other conveyor means, said means for moving said back support comprising lever means articulately connected with said back support and means for pivoting said lever means, and means for advancing said conveyor means to remove the stacks from said receptacles in the longitudinal direction of said row on movement of said portion of said one conveyor means to said first position.

10. The apparatus of claim 9, wherein said means for pivoting said lever means comprises fluid-operated motor means.

* * * * *